United States Patent [19]

Swisher

[11] 4,426,860

[45] Jan. 24, 1984

[54] LOCK AND KEY SYSTEM OF THE PLUNGER TYPE

[76] Inventor: James Swisher, Box 248, Southport, Conn. 06490

[21] Appl. No.: 281,701

[22] Filed: Jul. 9, 1981

[51] Int. Cl.[3] ..... E05B 67/36

[52] U.S. Cl. ..... 70/34; 70/404; 70/408

[58] Field of Search ..... 70/34, 386, 32, 33, 70/402, 403, 404, 408, 409

[56] References Cited

U.S. PATENT DOCUMENTS 2,525,344 10/1950 Garniss ..... 70/386

4,252,006 2/1981 Swisher ..... 70/34

*Primary Examiner*—Robert L. Wolfe

*Attorney, Agent, or Firm*—Robert E. Ross

[57] ABSTRACT

A lock and key combination in which the lock is of the plunger operated type and the key has elongated resilient fingers with a mandrel for expanding the ends of the fingers in an engagable portion of the lock plunger. The head of the lock is provided with a central recess, and the head of the key is provided with a forwardly extending spacer at the base of the fingers for entering the recess and axially positioning the ends of the fingers in relation to the engagable portion of the plunger. The structure of the interface between the lock and key allows the manufacture of locks and keys of various combinations, determined by the cross-sectional shape of the spacer and recess, and of various "levels" determined by the length of the spacer and the depth of the recess. In a lock and key of a higher "level" the spacer is longer, the recess is deeper, the resilient fingers are longer, and the engagable portion of the lock plunger is deeper in the lock housing. This structure insures that a key of one "level" cannot operate a lock of a higher "level" even if the spacer of the key and the recess of the lock have the same cross-sectional configuration. In one modification of the invention, the key is provided with a head which is axially adjustable to enable the key to open locks of a lower level.

9 Claims, 14 Drawing Figures

LOCK AND KEY SYSTEM OF THE PLUNGER TYPE

SUMMARY OF THE INVENTION

A plunger operated lock and key combination of the type in which the lock has an elongated body and an internal plunger axially movable against the force of a spring to release locking means, and the operating key for opening the lock has elongated plunger engaging mechanism which extends forwardly through the head of the key for entering the head of the lock, in which the head of the lock is provided with a recess, and the key is provided with a spacer disposed at the base of the fingers for entering the recess and axially positioning the fingers in relation to the lock operating means, and for positioning the head of the key against the head of the lock, so that when the key is operated to retract the plunger, full compression of the plunger spring is obtained. The structure of the interface between the lock and key allows the manufacture of locks and keys of various combinations, determined by the cross-sectional shape of the interface structure, and of various "levels," determined by the length of the interface structure. The interface structure disclosed herein allows the production of lock and key systems, in which the keys of one level will not operate locks of another level, or with certain modifications to the key, in which a key will open locks of a lower "level", but will not open locks of a higher "level". This is accomplished by varying the depth of the recess in the head of the lock and the position of the operating plunger, and the length of the spacer at the base of the key fingers. For example, for a second level of lock and key, the recess in the lock head and the position of the plunger can be slightly deeper and the spacer on the key can be slightly longer. A level one key cannot open the second level lock, since the fingers of the level one key cannot reach the operating plunger. A level two key cannot open a level one lock, even though the fingers can reach the operating plunger, since the greater length of the spacer at the base of the fingers prevents the head of the key from abuting the head of the lock, so that on operation of the key, the first portion of travel of the key fingers causes the key head to move toward the lock head, and only thereafter does the operating plunger move toward the unlocking position. Therefore, due to the loss of travel of the operating plunger, the key cannot pull the plunger all the way to the unlocking position.

However, a level two key, (or a key of a higher level), can be adapted to open a lower level lock by providing it with a head which is longitudinally adjustable forwardly, if needed, so that when the key is inserted into a lower level lock, the gap between the head of the key and the head of the lock can be closed, so that all of the travel of the key fingers goes into moving the operating plunger.

A lock and key of any level may also be coded by the cross-sectional configuration of the spacer on the key and the recess in the lock head, for example, by providing a series of keys with spacers that are basically circular, with various numbers of chords removed from the spacers, with the lock head recesses having shapes congruent to the spacer shapes.

A lock and key of any level may also be coded by providing the faces of the lock plungers with central posts of various lengths, and providing the end of the plunger engaging mechanism with a recess of appropriate depth, as more fully illustrated in my patent U.S. Pat. No. 4,252,006.

BACKGROUND OF THE INVENTION

In the utility industry, locks of the plunger operated type are often used to protect meters, meter boxes and valves that control the supply of electricity or gas. A suitable "key" or operating tool is provided to service personnel to enable them to open the locks as required. However these keys are often lost or stolen, and over a period of time many of these keys find their way into the hands of unauthorized personnel, who use them to remove and reverse meters, or to short across meter terminals, or to open valves that have been locked closed for nonpayment of utility bills.

Also, utilities that have adjoining territories prefer to have locks and keys that are not interchangeable, so that keys lost by service personnel of one utility cannot be used to open the locks of the adjoining utility.

Various efforts have been made to provide locks that can be opened only with a special key, and keys that cannot be modified to open other locks. For example, in my patent U.S. Pat. No. 4,252,006 there is illustrated a plunger lock and key in which the engaging means between the fingers of the key and the lock plunger have a configuration such that "generations" of locks and keys may be provided, so that a later "generation" key will open earlier "generation" locks, but will not open later generation locks. However in some cases the keys can be modified by unauthorized persons to open later generation locks.

DESCRIPTION OF THE ILLUSTRATED EMBODIMENTS

Figure 1:
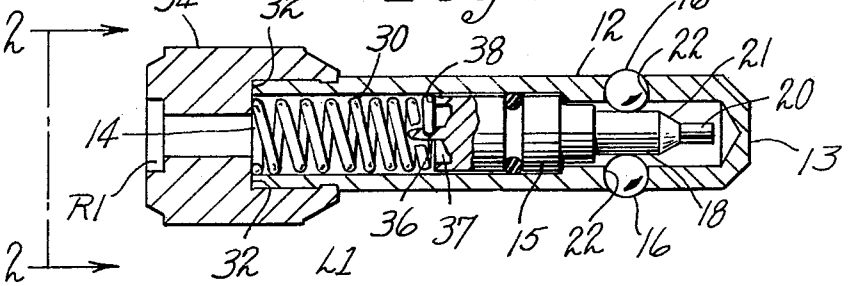
FIG. 1 is a view in side elevation, partly in section of a plunger type lock embodying the features of the invention, and referred to herein as a level 1 lock.
Figure 3:
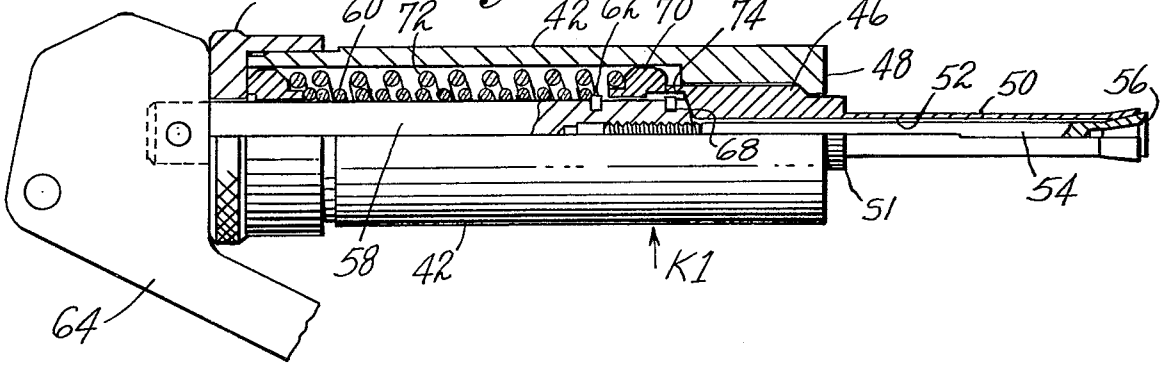
FIG. 3 is a view in side elevation, partly in section, of an operating key for use with the lock of FIG. 1, referred to herein as a level 1 lock.

Referring to FIGS. 1 and 3 of the drawing, there is illustrated, respectively a plunger-type lock L1 and an operating key K1 for use therewith, which embody the features of the invention.

The lock L1 may have an internal structure similar to that shown in my patent U.S. Pat. No. 4,252,006, and comprises generally an elongated housing 12 having a closed end 13, and open or head end 14, and a plunger 15 movable axially in the housing to move a pair of locking balls 16 between an unlocking and a locking position. The forward end of the plunger 14 is provided with a forwardly projecting ball positioning member having a rear portion 18 and a smaller forward portion 20 connected by a cam surface 21. The balls 16 are retained in suitable apertures 22 in the housing wall. The parts are so dimensioned that when the plunger is in the forward or locking position (as in FIG. 1) the portion 18 of the plunger is disposed between the balls, forcing them outwardly so that they project from the outer surface of the housing, and when the plunger is retracted, the balls can ride down the cam surface 21 to rest against the smaller portion 20, so that the outer periphery of the balls is at or inside the outer surface of the housing 12.

The plunger 15 is biased to the forward position by a spring 30 disposed between the end of the plunger and a spring retaining shoulder 32 in a lock head member 34 which is press fitted or otherwise retained in the open end 14 of the housing.

To provide means for retracting the plunger 15 to release the lock, the face of the plunger comprises a central projection 36 surrounded by a groove 37 having an peripheral wall 38 for co-operating with the operating key in a manner to appear hereinafter.

As disclosed in U.S. Pat. No. 4,063,434, the spring 30 must be completely compressed so that the coils are touching each other to allow the plunger 15 to move rearwardly far enough to allow the balls to retract to the unlocking position.

The above described internal structure of the lock L1 is known in the art, and is illustrated in U.S. Pat. Nos. 3,186,196 and 4,252,006.

The operating key K1 comprises a housing 42, closed at the rear end by a retaining cap 44 and closed at the forward end by an operating finger carrier 46, which is retained at the forward end of the housing by an inwardly extending peripheral flange 48.

Disposed on the forward end of the carrier 46 is a spacer S and a group of spring fingers 50 projecting forwardly therefrom. The carrier 46 and the spacer 48 have a central aperture 52 which receives a mandrel 54. The forward end of the mandrel 54 is disposed within the fingers, terminating in an enlarged head 56, and the rear end thereof is retained in an operating rod 58. The rod 58 and the mandrel 54 are biased forwardly by an inner spring 60 disposed between the cap 44 at the rear end of the housing and a retaining ring 62 mounted on the operating rod. Forward motion of the operating rod is limited by engagement of the forward end of the operating rod with the rear end of the carrier 46.

Operation of the handle 64 connected to the rear end of the operating rod 58 draws the rod rearwardly to pull the mandrel head 56 inwardly between the forward ends of the fingers 50 to cause them to spread outwardly. When the handle 64 is operated without the ends of the fingers being confined in the recess of a lock plunger, the rod and mandrel move rearwardly in relation to the fingers until a retaining ring 68 on the forward end of the operating rod engages the forward side of an axially movable bushing 70 disposed around the operating rod. The bushing 70 is biased forwardly to bear against the rear end of the carrier 46 by an outer spring 72 which is disposed between the bushing 70 and the end cap 44.

The forward end of the bushing 70 and the rear end of the carrier 46 are shaped to provide a peripheral gap 74 within which the retaining ring 68 can move.

After the retaining ring 68 engages the bushing 70, further rearward movement of the operating rod causes the bushing 70 to also move rearwardly, thereby allowing the carrier 40 and fingers 50 to move rearwardly with the mandrel 54. Further movent of the mandrel head 56 into the fingers, which could cause permanent deformation of the fingers, is thereby prevented.

However, when the ends of fingers 50 are confined within a recess of the plunger of a lock, operation of the handle 64 causes the fingers to expand against the peripheral wall of the recess, thereby limiting the maximum outside diameter of the fingers, before the retaining ring 68 reaches the forward face of the bushing 70. Thereafter the engagement of the fingers with the recess wall causes the fingers, the carrier, and the bushing 70 to move rearwardly with further rearward movement of the operating rod, to pull the lock plunger in the direction of the unlocking position as will appear hereinafter.

The above described mechanism, whereby resilient fingers expanded by an internal mandrel are used to engage and operate a lock plunger is known in the art, and is illustrated in U.S. Pat. No. 4,252,006. However certain features of the structure of the key K1 are novel. Some of these novel features that cooperate with the lock L1 are claimed herein, and other features are claimed in my copending application Ser. No. 281,704 filed July 9, 1981.

Figure 2:
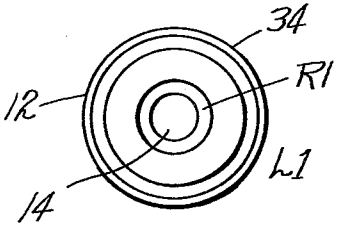
FIG. 2 is a view of the lock of FIG. 1 as seen from the right, or head, end.

As illustrated in FIGS. 1 and 2, the head 14 of the lock L1 is provided with a recess R1, which receives the spacer S1 on the forward end of the key K1.

By providing recesses of various depths and spacers of various lengths, "levels" of locks and keys may be provided as will now be described, in which a key of a first "level" will not open locks of a later or higher "level", and such a key cannot be modified to do so without destroying the key. However keys of a higher "level" may be constructed with a suitable adjustment feature that enables them to open locks not only of their own level, but also locks of any lower level.

Figure 4:
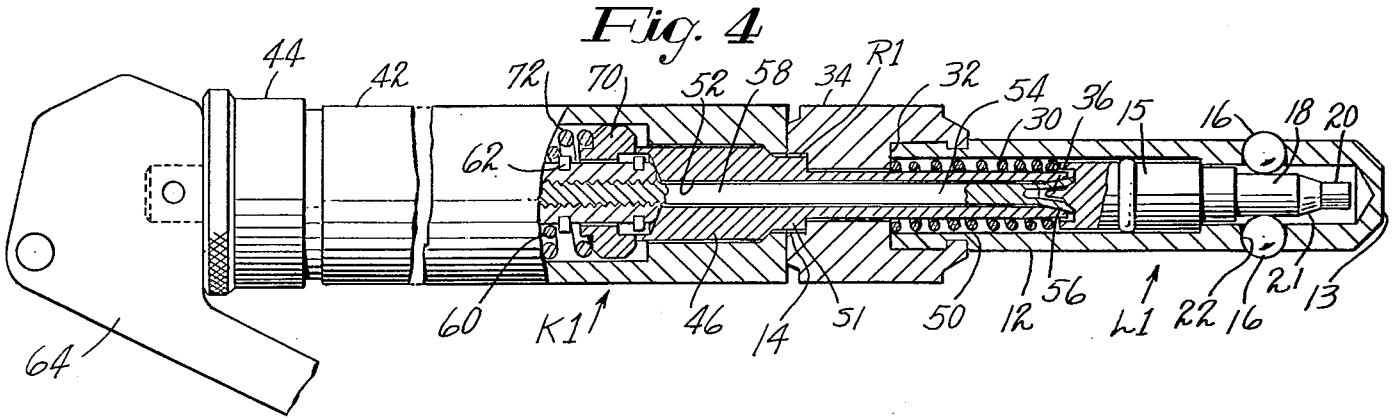
FIG. 4 is a view in side elevation of the lock of FIG. 1 and the key of FIG. 3 assembled for opening the lock.
Figure 5:
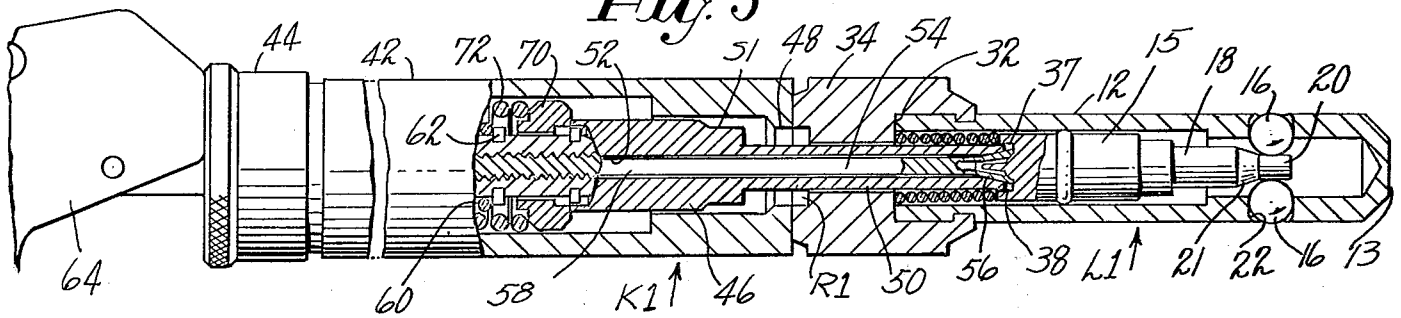
FIG. 5 is a view similar to FIG. 4 in which the key has pulled the operating plunger of the lock to the unlocking position.

FIGS. 4 and 5 illustrate the use of the key K1 of FIG. 3, which may be considered a level 1 key, to open the lock L1 of FIGS. 1 and 2, which may be considered to be a level 1 lock, As illustrated therein, it is seen that the depth of recess R1 and the length of spacer S1 are substantially the same, so that when the key K1 is inserted into the lock, when the forward end of the spacer S1 reaches the bottom of recess R1, the forward face of the housing 42 is substantially touching the rear face of the lock head member 34, and the ends of the fingers 50 are disposed in the groove 37 far enough to enable the fingers 50 to engage the wall 38 thereof when the tool K1 is operated.

An important feature of the herein illustrated lock and key structure, which enables the provision of "levels" of locks and keys, is the fact that the proper position of the ends of the fingers 50 in the lock is determined by the engagement of the forward face of the spacer S1 with the bottom of the recess R, and not by the engagement of the forward face of the key housing 42 with the rear face of the lock head 34, as in previously known locks and keys of this type. Although in an assembled lock and key of the same first level, the spacing between the front face of the key housing and the rear face of the lock is negligable, the fact that the position of the fingers in the lock, for proper operation, is determined by the spacer becomes important when a key of one level is inserted into a lock of another level, as will appear hereinafter.

As illustrated in FIG. 5, it is seen that to enable the plunger to reach the unlocking position, the spring 30 must be completely compressed so that the spring coils are touching each other. This feature is illustrated and claimed in U.S. Pat. No. 4,063,434, and is useful in the herein illustrated lock and key system, as will appear hereinafter.

Figure 6:
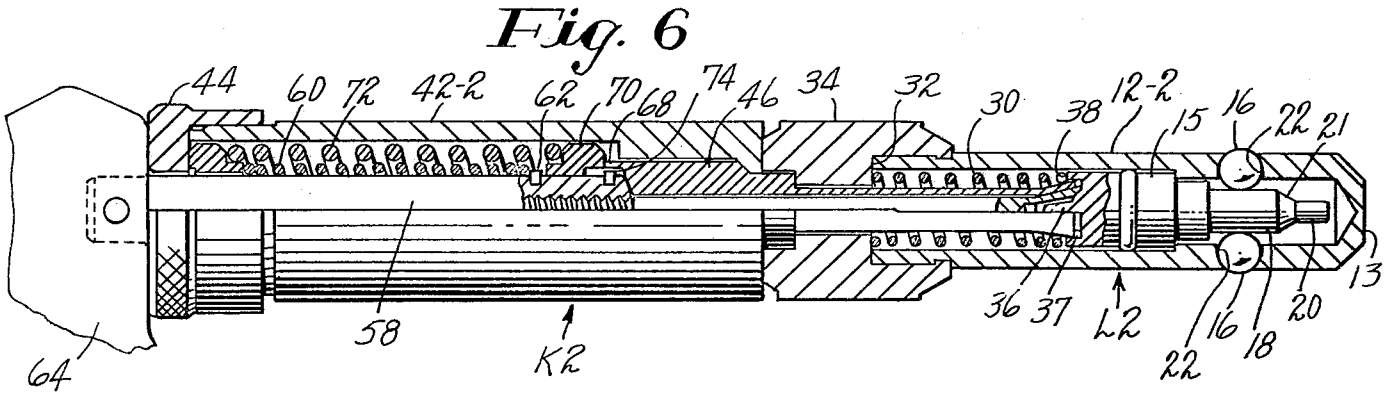
FIG. 6 is a view in side elevation, partly in section, of a lock similar to that of FIG. 1, but with certain dimensions changed, and a key assembled therewith, said key being similar to the key of FIG. 3, but with certain dimensions changed to accomodate the lock. The lock and key of this Figure are referred to herein as a level 2 lock and key.

Referring to FIG. 6, there is illustrated a lock L2 and Key K2 similar to that of FIGS. 1–5, in which a spacer S2 on the key K2 has a length which is a predetermined amount greater than that of the spacer 31 of the key of FIG. 3. Also, the recess R2 in the lock L2 is deeper than the recess R1 in lock L1 by said same predetermined amount. However, the distance from the bottom of the recess R2 to the groove 37-2 of the plunger 15-2 is the same as in the lock L1, and the distance from the forward end of the spacer S2 to the forward end of the fingers 50-2 is the same as the corresponding distance in the key K1.

The lock L2 and key K2 of FIG. 6 operate in the same manner as lock L1 and key K2 of FIGS. 1–6, in that when the key K2 is assembled with the lock L2 with the forward face of the spacer S2 bottoming against the bottom of the recess R2, the forward face of the housing 42-2 is substantially touching the rear face of the lock head 34-2, so that when the key handle 64-2 is operative, all of the motion of the operating rod 58-2 and mandrel 54-2 results in motion of the plunger 15-2, and none of the operating rod and mandrel motion is wasted in drawing the lock against the key.

Figure 7:
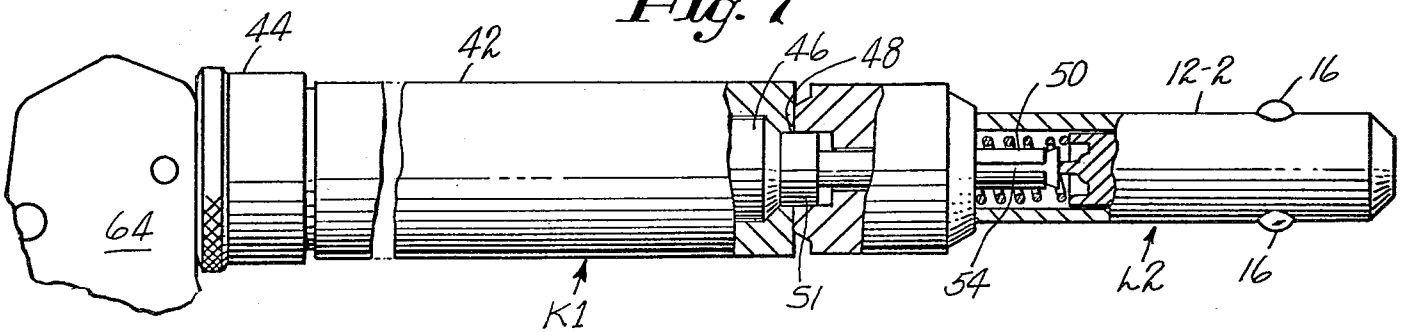
FIG. 7 is a view in side elevation, partly in section, of the level 2 lock of FIG. 6 with the level 1 key of FIG. 3 assembled therewith.

Referring now to FIG. 7, there illustrated the level 2 lock L2 of FIG. 7 with the level 1 key K1 of FIG. 3 assembled therein. The key K1 is unable to open the lock L2 because spacer S1 of the key K1 is unable to seat in the recess R2 far enough to allow the fingers 50 to reach the plunger recess 37-2.

In many prior types of keys in such cases it has been possible to adapt an unauthorized key (in which the fingers are too short) to operate a lock with a deeper plunger by simply grinding back the head of the key so that the fingers can reach deeper into the key. However, if the front face of the housing 42 of the key K1 is ground off, to an extent such that the flange 38 is removed, the spring 50 will force the bushing 54 and the finger carrier 44 forwardly until the bushing encounters the stop 35 on the interior wall of the housing. The forward movement of the finger carrier will cause the fingers 48 to move forwardly in relation to the mandrel, spreading the ends of the fingers on the mandrel head, so that the overall diameter of the finger group at the ends thereof is too great to allow insertion into a lock.

Figure 8:
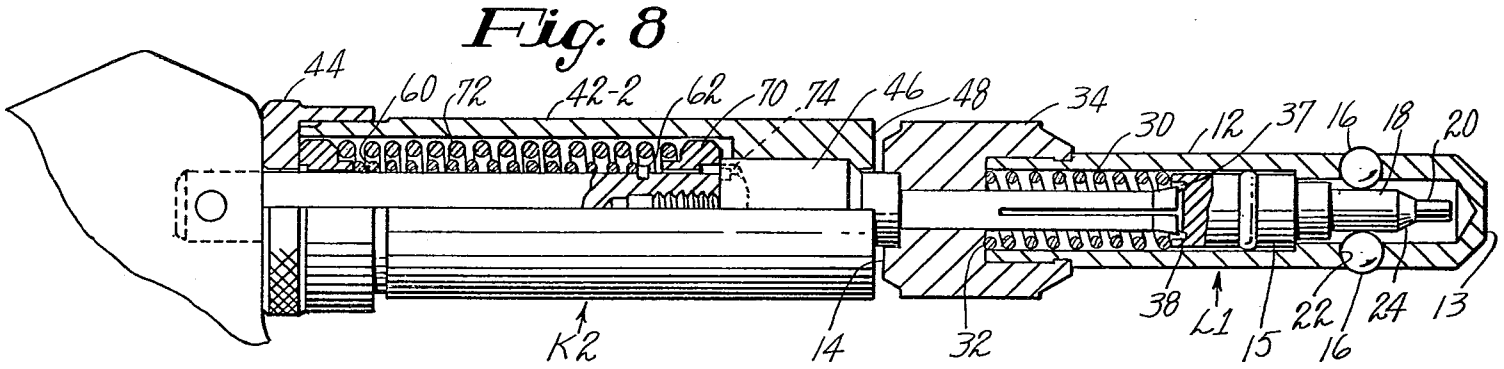
FIG. 8 is a view of the level 1 lock of FIG. 1 with the level 2 key of FIG. 6 assembled therewith.
Figure 9:
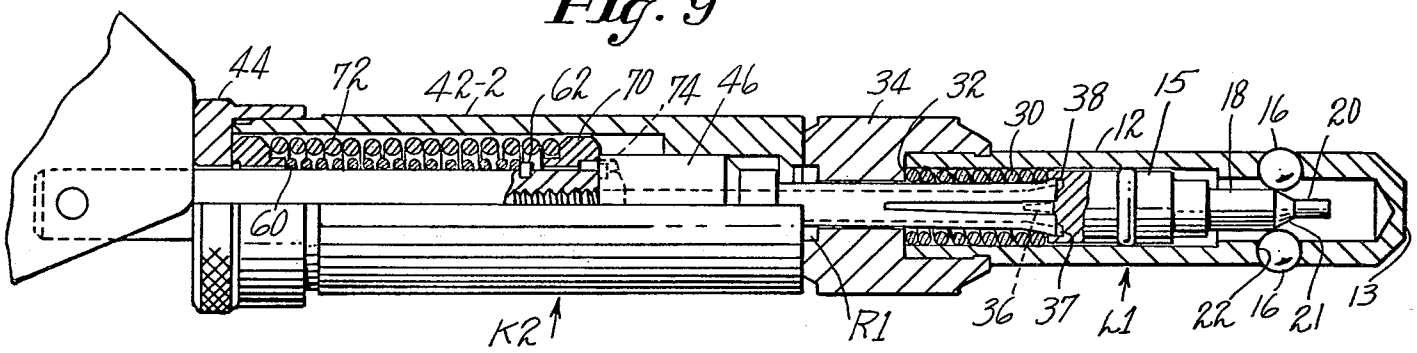
FIG. 9 is a view of the assembly of FIG. 8 in which the key has been operated to pull the lock plunger as far as the key is able to pull it.

Referring now to FIG. 8, there is illustrated the level 1 lock L1 of FIG. 1 with the level 2 key K2 of FIG. 6 assembled therein; and FIG. 9 is a view of the assembly of FIG. 8 in which the operating handle 64-2 of key K2 has been operated to move the operating rod 58-2, mandrel 54-2 and plunger 15 of lock L1 as far as possible toward the unlocking position.

As seen in FIG. 8, when the key K2 is assembled into the Lock L1 the spacer S2 is able to bottom in the recess R1, with the fingers 50-2 of the key entering the plunger groove 37. However, when so assembled, the head of the key K2 is spaced from the head of the lock L1 by a distance which is equal to the difference in length between the spacer S2 and the spacer S1 of key K1. Therefore when the handle 64-2 of key 2 is operated the first portion of the motion of mandrel 54-2 causes the fingers 50-2 to be spread into engagement with the wall of the plunger recess, (as also occurs in the operation of the lock and key of FIGS. 5 and 6), however the second portion of the motion of the mandrel 54-2 causes the lock L1 to be drawn against the key K2 so that the rear face of the lock head 34 bears against the face of the key housing 42. Only thereafter does motion of the mandrel cause motion of the plunger 15 toward the unlocking position. However, as illustrated in FIG. 9, the plunger 15 can never reach the unlocking position, since a portion of the available travel of the mandrel was required to draw the lock and key together before the plunger started to move.

Figure 10:
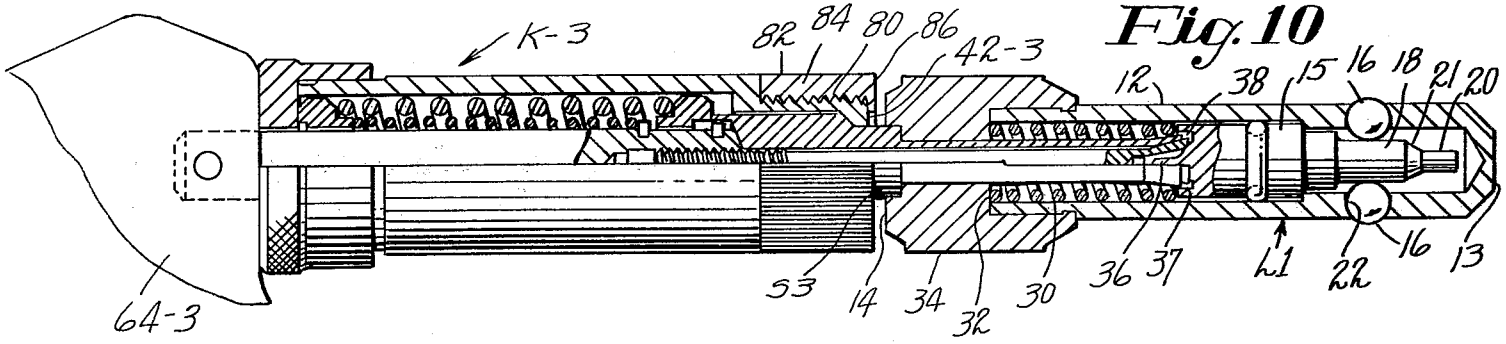
FIG. 10 is a view in side elevation, partly in section, of a modified form of key which is capable of opening either a level 1 or a level 2 lock, shown assembled into a level 1 lock, and adjusted for use in a level 2 lock.
Figure 11:
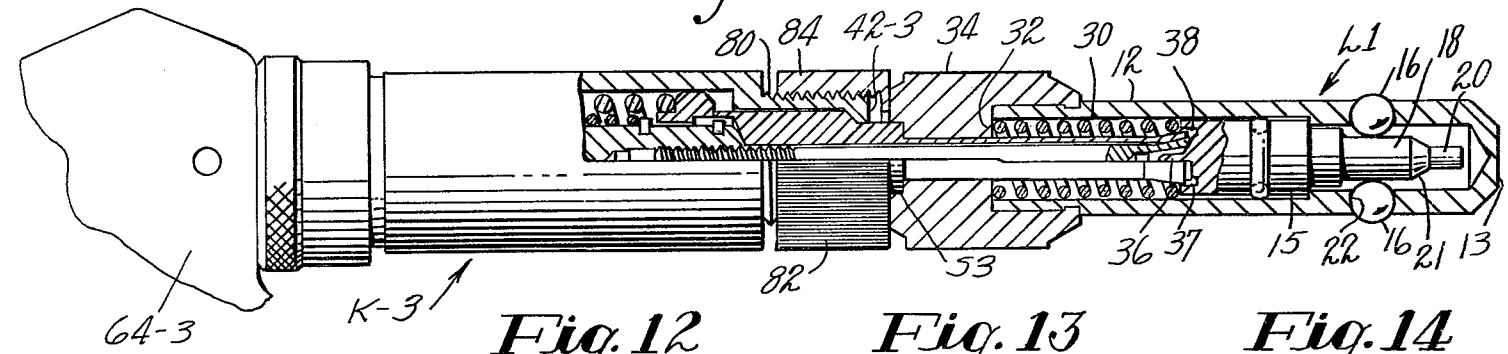
FIG. 11 is a view of the assembly of FIG. 10, in which the key has been adjusted for use in a level 1 lock by rotating the head of the key to close the gap between the head of the key and the head of the lock.

However, as illustrated in FIGS. 10 and 11, a special key K3 may be provided which is capable of opening locks of its own level andall lower levels. FIG. 10 illustrates the key K3, adjusted for a level 2 lock, assembled into a level 1 lock. The key K3 may be identical in structure to the keys K1 and K2, however the forward end of the housing 42-3 has been provided with a threaded portion 80 which is smaller in diameter than the remainder of the housing, and an adjusting cap 82 threaded into engagement with the portion 80. The cap 82 has an internally threaded wall 84, and a forward face 86 which has a central aperture through which the spacer S3 extends.

The key K3 can be designed to fit a lock of any predetermined level and all lower levels. When the threaded cap 82 is screwed onto the housing as far as possible, it allows a length of spacer S3 to protrude from the face of the cap which is equal to the depth of the recess of the highest level of lock with which the key K3 is intended for use.

For example, if the adjustable key K3 is intended for use only with level 2 and level 1 locks, the length of the spacer S3, when the adjustment cap 82 is in the rearmost position, is the same as the length of the spacer of the key K2 previously described, which is the same as the depth of the head recess of the level 2 lock L2. Therefore the key K3 can be used to open a level 2 lock when the adjustment cap is in the rearmost position.

As illustrated in FIG. 10, when the key K3 is assembled with a level 1 lock such as L1 with the adjustment cap in the rearmost position, the front face of the adjustment cap is spaced from the rear face of the lock head 34 when the spacer S3 bottoms in the recess R1, just as in the case of the Key K2 previously described.

Therefore the key K3, in the condition illustrated in FIG. 10, cannot operate the lock L1, because a portion of the travel of the lock operating rod is used to draw the lock and key together.

However, the key K3 may be adjusted to enable it to operate lock L1 by rotating the adjusting cap 82 to move it forwardly until it touches the rear face of the lock head. Thereafter the operation of the handle 64-3 of K3 will move the plunger of lock L1 to the unlocking position.

In the illustrated embodiments, two levels of locks and keys have been illustrated, however it will be understood that a lock and key system may be provided which has many levels of locks and keys. Each key for any level above the first level may be provided with an adjustment head in the manner described, which has a spacer length, with the adjustment cap in the rearmost position, that is appropriate for the highest level the key is intended to operate, with the adjustment cap being adjustable forwardly to shorten the effective spacer length to substantially equal the depth of the recess of a lower level lock to be opened, so that when the key is inserted into such lower level lock, the front face of the adjustment cap substantially touches the rear face of the Lock housing, and the front face of the spacer substantially seats in the bottom of the lock recess. The key will therefore open any lock of a lower level for the reasons described above.

In addition to the various "levels" of locks and keys, the locks and keys may be coded by the configuration of the mating shape of the spacer projecting from the key and the recess in the lock head.

Figure 14:
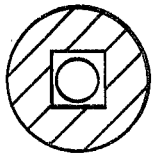
FIG. 14 is a view in section of a key spacer of a fourth configuration inserted into a lock head having a recess with said fourth configuration.
Figure 13:
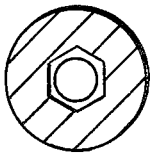
FIG. 13 is a view in section of a key spacer of a third configuration inserted into a lock head having a recess with said third configuration.
Figure 12:
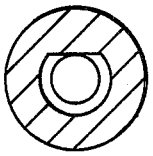
FIG. 12 is a view in section of a key spacer of a second configuration inserted into a lock head having a recess with said second configuration.

For example, the locks and keys illustrated herein in FIGS. 1–11 are provided with recesses and spacers which are circular in cross-section. However, the recesses and spacers may be further coded by providing them with spacer and recess shapes which have other configurations, as illustrated in FIGS. 12–14, in which is illustrated cross-sectional views of assembled locks and keys having various shapes of spacers and recesses, with the section being taken at the interface of the lock head and the key head. The spacers and recesses may be so dimensioned that a key having a spacer of one shape cannot be received into the recess of a lock with another shape.

The locks and keys may also be coded in the manner illustrated in my patent U.S. Pat. No. 4,252,006, that is, by providing "generations" of locks and keys with different lengths and configurations of the center post on the plunger and the depths and configurations of the recess in the end of the key mandrel.

Thus each level of lock and key may be coded in two different ways, so that even though a key may be of the same level as a lock, it cannot open the lock unless the mating shape of the spacer and recess are the same, and unless the mating shape of the end of the key mandrel and the lock plunger face are the same.

Since certain changes apparent to one skilled in the art may be made in the herein illustrated embodiments of the invention without departing from the scope thereof, it is intended that all matter contained herein be interpreted in an illustrative and not a limiting sense.

I claim:

1. In combination, a lock of the plunger operated type comprising a hollow housing having a head with an aperture receiving an axially movable operating plunger having an engagable end and an operating key with a head and an elongated plunger-engaging mechanism projecting forwardly from the head for entering the lock aperture, said lock head having a recess of predetermined depth disposed around said aperture, and said key having a spacer projecting forwardly of the head a distance substantially equal to the depth of the recess of the lock.

2. A lock and key system of the type in which the lock comprises an elongated hollow housing with an internal operating plunger and a central opening from the plunger to a head end of the lock, a recess in said head end disposed about the central opening, and an operating key having a head and an elongated plunger-engaging mechanism projecting forwardly therefrom, and a spacing member disposed on the head about the plunger engaging mechanism, said system providing various "levels" of locks and keys by comprising a series of locks having successively deeper recesses in the head and a series of keys having successively longer spacing members projecting forwardly of the head, each spacing member having a length equal to the depth of the recess of the corresponding lock.

3. A lock and key system as set out in claim 2 in which a predetermined amount of movement of the plunger of a lock of the series is required to effect unlocking, and the corresponding key of the series is capable of providing only that predetermined amount of movement.

4. A system as set out in claim 3 in which means is provided on the forward end of the key capable of forward adjustment to decrease the effective amount of projection of the spacing member and to thereby close the gap between the head of the key and the head of the lock when a key with a spaced of a predetermined length is inserted into a lock with a recess having a depth less than the length of the spacer.

5. A series of locks and keys of the type in which the lock comprises an elongated housing having a head end with an internal operating plunger having an engagable end portion, a central opening from the engagable end portion of the plunger to the head end of the lock, and an operating key having a head and an elongated plunger engaging mechanism projecting forwardly therefrom for entering the lock aperture, said series providing various "levels" of locks and keys in which a key of one level cannot open a lock of some other levels, the locks of said series having head recesses of progressively greater depth and the keys of said series having spacers of progressively greater length projecting forwardly of the head, each spacer having a projecting length equal to the depth of the recess in a corresponding lock of the series, and the series of locks having the engagable end of the plungers at a progressively greater depth from the head of the lock, the distance from the bottom of the recess in the lock head to the engagable end of the plunger being constant throughout the series.

6. A series of locks and keys as set out in claim 5 in which the distance from the forward end of the spacer on the key to the end of the plunger engaging mechanism is constant throughout the series.

7. A lock and key system, comprising a series of locks of the type having a lock operating plunger in an elongated housing having a head with an aperture from an engagable end of the plunger to the head of the lock, and an operating key having a head and an elongated plunger engaging mechanism extending forwardly through the head for entering the aperture and engaging the end of the plunger, said series of locks having progressively deeper central recesses in the head, the distance from the face of the head to the engagable end of the plunger being progressively greater so that the distance from the bottom of the recess in the head to the engagable end of the plunger is constant throughout the series, said series of keys having spacers disposed about the base of the plunger engaging mechanism and extending forwardly of the key head to enter the lock recesses, said spacers being progressively longer and the distance from the key head to the end of the plunger engaging mechanism being progressively greater throughout the series of keys so that the distance from the forward end of the spacer to the forward end of the plungerengaging mechanism is constant throughout the series, each key having a spacer length equal to the depth of the recess of a corresponding lock, and a plunger engaging mechanism length corresponding to the distance from the head of said corresponding lock to the engagable end of the plunger, each lock of the series requiring the same predetermined plunger movement toward the lock head to effect unlocking, each key of said series being capable of causing only said predetermined movement of the lock plunger, whereby when a key with a spacer of one length is inserted into a lock having a recess of a depth greater than said one length, the key cannot open the lock because the plunger engaging mechanism cannot reach the engagable end of the lock plunger and when said key is inserted into a lock having a recess with less depth than the length of the spacer, the key cannot open the lock because the head of the key is spaced from the head of the lock so that on operating the key, some of the motion of the plunger engaging mechanism is utilized to draw the head of the key against the head of the lock, preventing the lock operating plunger from achieving its required travel.

8. A lock and key system as set out in claim 7 in which the key head is adjustable axially in relation to the spacer to close the gap between the key head and the lock head when the key is inserted into a lock having a recess of lesser depth than the maximum effective length of the spacer.

9. A lock and key system utilizing a series of locks and keys of the type set out in claim 1 in which the locks of the series have center posts of increasing length on the engagable end of the plunger and the keys have recesses of increasing depth in the forward ends of the plunger engaging mechanism whereby a key cannot engage a plunger which has a center post longer than the the depth of the recess in the forward end of the plunger engaging mechanism.

* * * * *

REEXAMINATION CERTIFICATE (1481st)

United States Patent [19] [11] B1 4,426,860

Swisher [45] Certificate Issued Jun. 4, 1991

[54] LOCK AND KEY SYSTEM OF THE PLUNGER TYPE

[76] Inventor: James Swisher, Box 248, Southport, Conn. 06490

Reexamination Request:
No. 90/001,422, Jan. 19, 1988

Reexamination Certificate for:

| | |
|---|---|
| Patent No.: | **4,426,860** |
| Issued: | **Jan. 24, 1984** |
| Appl. No.: | **281,701** |
| Filed: | **Jul. 9, 1981** |

[51] Int. Cl.[5] ..... E05B 19/18; E05B 35/06

[52] U.S. Cl. ..... 70/34; 70/386; 70/395; 70/411; 70/412

[58] Field of Search ..... 70/32–34, 70/386, 402–404, 408–409, 411, 395, 412; 24/211 N

[56] References Cited

U.S. PATENT DOCUMENTS

| | | | |
|---|---|---|---|
| 4,252,006 | 2/1981 | Swisher | 70/34 |
| 4,313,319 | 2/1982 | Haus et al. | 70/34 |

*Primary Examiner*—Robert L. Wolfe

[57] ABSTRACT

A lock and key combination in which the lock is of the plunger operated type and the key has elongated resilient fingers with a mandrel for expanding the ends of the fingers in the engagable portion of the lock plunger. The head of the lock is provided with a central recess, and the head of the key is provided with a forwardly extending spacer at the base of the fingers for entering the recess and axially positioning the ends of the fingers in relation to the engagable portion of the plunger. The structure of the interface between the lock and key allows the manufacture of locks and keys of various combinations, determined by the cross-sectional shape of the spacer and recess, and of various "levels" determined by the length of the spacer and the depth of the recess. In a lock and key of a higher "level" the spacer is longer, the recess is deeper, the resilient fingers are longer, and the engagable portion of the lock plunger is deeper in the lock housing. This structure insures that a key of one "level" cannot operate a lock of a higher "level" even if the spacer of the key and the recess of the lock have the same cross-sectional configuration. In one modification of the invention, the key is provided with a head which is axially adjustable to enable the key to open locks of a lower level.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, line 64 to column 4, line 7:

Disposed on the forward end of the carrier 46 is a spacer S and a group of spring fingers 50 projecting forwardly therefrom. The carrier 46 and the spacer [48] *S1* have a central aperture 52 which receives a mandrel 54. The forward end of the mandrel 54 is disposed within the fingers, terminating in an enlarged head 56, and the rear end thereof is retained in an operating rod 58. The rod 58 and the mandrel 54 are biased forwardly by an inner spring 60 disposed between the cap 44 at the rear end of the housing and a retaining ring 62 mounted on the operating rod. Forward motion of the operating rod is limited by engagement of the forward end of the operating rod with the rear end of the carrier 46.

AS A RESULT OF REEXAMINATION, IT HAS BEEN DETERMINED THAT:

Claims 2–3, 5–7 and 9 are cancelled.

Claims 1, 4 and 8 are determined to be patentable as amended.

New claim 10 is added and determined to be patentable.

1. In combination, a lock of the plunger operated type comprising a hollow housing having a head with an aperture receiving an axially movable operating plunger having an engagable end and an operating key with a head and an elongated plunger-engaging mechanism projecting forwardly [from] *through* the head *and axially moveable with respect to the head* for entering the lock aperture, said lock head having a recess of predetermined depth disposed around said aperture, and said key having a spacer *mounted on and* projecting forwardly of the head a distance substantially equal to the depth of the recess of the lock *when the forward face of the spacer is in engagement with the bottom of the recess.*

4. [A system as set out in claim 3 in which] *A lock and key system of the type in which the lock comprises an elongated hollow housing with an internal operating plunger and a central opening from the plunger to a head end of the lock, a recess in said head end disposed about the central opening, and an operating key having a head and an elongated plunger-engaging mechanism projecting forwardly therefrom, and a spacing member disposed on the head about the plunger engaging mechanism, said system providing various "levels" of locks and keys by comprising a series of locks having successively deeper recesses in the head and a series of keys having successively longer spacing members projecting forwardly of the head, each spacing member having a length equal to the depth of the recess of the corresponding lock, wherein a predetermined amount of movement of the plunger of a lock of the series if required to effect unlocking, and the corresponding key of the series is capable of providing only that predetermined amount of movement, and* means is provided on the forward end of the key capable of forward adjustment to decrease the effective amount of projection of the spacing member and to thereby close the gap between the head of the key and the head of the lock when a key with a spaced of a predetermined length is inserted into a lock with a recess having a depth less than the length of the spacer.

8. [A lock and key system as set out in claim 7] *A lock and key system, comprising a series of locks of the type having a lock operating plunger in an elongated housing having a head with an aperture from an engagable end of the plunger to the head of the lock, and an operating key having a head and an elongated plunger, engaging mechanism extending forwardly through the head for entering the aperture and engaging the end of the plunger, said series of locks having progressively deeper central recesses in the head, the distance from the face of the head to the engagable end of the plunger being progressively greater so that the distance from the bottom of the recess in the head to the engagable end of the plunger is constant throughout the series, said series of keys having spacers disposed about the base of the plunger engaging mechanism and extending forwardly of the key head to enter the lock recesses, said spacers being progressively longer and the distance from the key head to the end of the plunger engaging mechanism being progressively greater throughout the series of keys so that the distance from the forward end of the spacer to the forward end of the plunger engaging mechanism is constant throughout the series, each key having a spacer length equal to the depth of the recess of a corresponding lock, and a plunger engaging mechanism length corresponding to the distance from the head of said corresponding lock to the engagable end of the plunger, each lock of the series requiring the same predetermined plunger movement toward the lock head to effect unlocking, each key of said series being capable of causing only said predetermined movement of the lock plunger, whereby when a key with a spacer of one length is inserted into a lock having a recess of a depth greater than said one length, the key cannot open the lock because the plunger engaging mechanism cannot reach the engagable end of the lock plunger and when said key is inserted into a lock having a recess with less depth than the length of the spacer, the key cannot open the lock because the head of the key is spaced from the head of the lock so that on operating the key, some of the motion of the plunger engaging mechanism is utilized to draw the head of the key against the head of the lock, preventing the lock operating plunger from achieving its required travel, and* in which the key head is adjustable axially in relation to the spacer to close the gap between the key head and the lock head when the key is inserted into a lock having a recess of lesser depth than the maximum effective length of the spacer.

*10. A key for use with a lock of the type comprising a hollow housing having a head with an aperture receiving an axially movable operating plunger having an engageable end; said lock head having a recess of predetermined depth disposed around said aperture, wherein said key has a key head and an elongated plunger engaging mechanism projecting forwardly through said key head and axially movable with respect to said key head for entering the lock aperture, said key having a spacer mounted on and projecting forwardly of the key head by an axially adjustable distance to match the predetermined distance of the lock recess when the key is inserted into the lock.*

* * * * *